US007850283B2

(12) United States Patent
Piatt et al.

(10) Patent No.: US 7,850,283 B2
(45) Date of Patent: Dec. 14, 2010

(54) PRINTHEAD WITH LIQUID FLOW THROUGH DEVICE

(75) Inventors: Michael J. Piatt, Dayton, OH (US); Chang-Fang Hsu, Beavercreek, OH (US); Shan Guan, Dublin, OH (US); Richard W. Sexton, Bainbridge, OH (US); Michael F. Baumer, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/429,205

(22) Filed: Apr. 24, 2009

(65) Prior Publication Data

US 2010/0271436 A1 Oct. 28, 2010

(51) Int. Cl.
*B41J 2/04* (2006.01)
*B41J 2/14* (2006.01)
*B41J 2/16* (2006.01)

(52) U.S. Cl. ..... 347/54; 347/47

(58) Field of Classification Search ..... 347/54, 347/73, 75, 77
See application file for complete search history.

(56) References Cited

U.S. PATENT DOCUMENTS 3,719,952 A 3/1973 Elbaum
3,893,623 A 7/1975 Toupin
4,345,259 A 8/1982 Reitberger
4,835,554 A 5/1989 Hoisington et al.
5,156,306 A 10/1992 Perera
5,379,060 A 1/1995 Yoshimura
2001/0035893 A1 * 11/2001 Lerat et al. ..... 347/47
2007/0291082 A1 12/2007 Piatt et al.

FOREIGN PATENT DOCUMENTS

EP 0 911 165 3/2003
GB 2282569 4/1995
JP 10100408 A * 4/1998
WO WO 95/10415 4/1995

OTHER PUBLICATIONS

U.S. Appl. No. 12/024,360, filed Feb. 1, 2008, Liquid Drop Dispenser With Movable Deflector, Yonglin Xie et al.
U.S. Appl. No. 11/944,658, filed Nov. 26, 2007, Liquid Drop Dispenser With Movable Deflector, Yonglin Xie et al.

* cited by examiner

*Primary Examiner*—Matthew Luu
*Assistant Examiner*—Lisa M Solomon
(74) *Attorney, Agent, or Firm*—William R. Zimmerli

(57) ABSTRACT

A liquid drop ejector is disclosed including a nozzle structure and a thermal actuator. The nozzle structure includes a nozzle and a wall. The nozzle includes an end and the wall extends from the end of the nozzle. The thermal actuator is associated with at least one of the nozzle and the wall, and is operable to add surface energy to at least one of the nozzle and the wall to cause a directional change in a liquid flowing through the nozzle structure.

20 Claims, 9 Drawing Sheets

PRINTHEAD WITH LIQUID FLOW THROUGH DEVICE

CROSS REFERENCE TO RELATED APPLICATIONS

Reference is made to commonly-assigned, U.S. Patent Publication No. 2007/0291082, and commonly-assigned, U.S. patent applications Ser. No. 12/024,360 filed Feb. 1, 2008, entitled "LIQUID DROP DISPENSER WITH MOVABLE DEFLECTOR" and Ser. No. 11/944,658 filed Nov. 26, 2007, entitled "LIQUID DROP DISPENSER WITH MOVABLE DEFLECTOR".

FIELD OF THE INVENTION

This invention relates generally to the field of digitally controlled printing devices, and in particular to printing devices that release drops only when required for printing from a continuous flow of liquid moving through the device.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Continuous inkjet printing uses a pressurized liquid source that produces a stream of drops some of which are selected to contact a print media while other are selected to be collected and either recycled or discarded. For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

Drop on demand printing only provides drops for impact upon a print media. Selective activation of an actuator causes the formation and ejection of a drop that strikes the print media. The formation of printed images is achieved by controlling the individual formation of drops.

Typically, one of two types of actuators is used in drop on demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled. Examples of commonly produced piezoelectric materials are ceramic materials, such as lead zirconate titanate, barium titanate, lead titanate, and lead metaniobate.

SUMMARY OF THE INVENTION

It has been determined that the speed capabilities of a DOD (drop on demand) printing system can be increased by having a continuous flow of liquid through the printhead of the system and selective displace a portion of the liquid in the form of a drop when a printing drop is required. A continuous liquid flow through the printhead of the system decreases the time to refill the liquid chamber that is in liquid communication with an associated nozzle after drop ejection. This in turn dramatically increases the response time of the system.

Accordingly, one feature of the present invention provides a liquid drop ejector that selectively displaces liquid in the form of drop from a continuous flow of liquid through the ejector.

According to another feature of the present invention, a liquid drop ejector includes a nozzle structure and a thermal actuator. The nozzle structure includes a nozzle and a wall, the nozzle including an end, where the wall extends from the end of the nozzle. The thermal actuator is associated with at least one of the nozzle and the wall, and is operable to add surface energy to at least one of the nozzle and the wall to cause a directional change in a liquid flowing through the nozzle structure.

According to another feature of the present invention, a method of ejecting liquid through a liquid drop ejector includes providing a nozzle structure including a nozzle and a wall, the nozzle including an end, the wall extending from the end of the nozzle; and causing a directional change in a liquid flowing through the nozzle structure by actuating a thermal actuator that is operatively associated with one of the nozzle and the wall to add surface energy to one of the nozzle and the wall.

According to another feature of the present invention, the method of ejecting liquid through a liquid drop ejector includes causing a second directional change in the liquid flowing through the nozzle structure.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
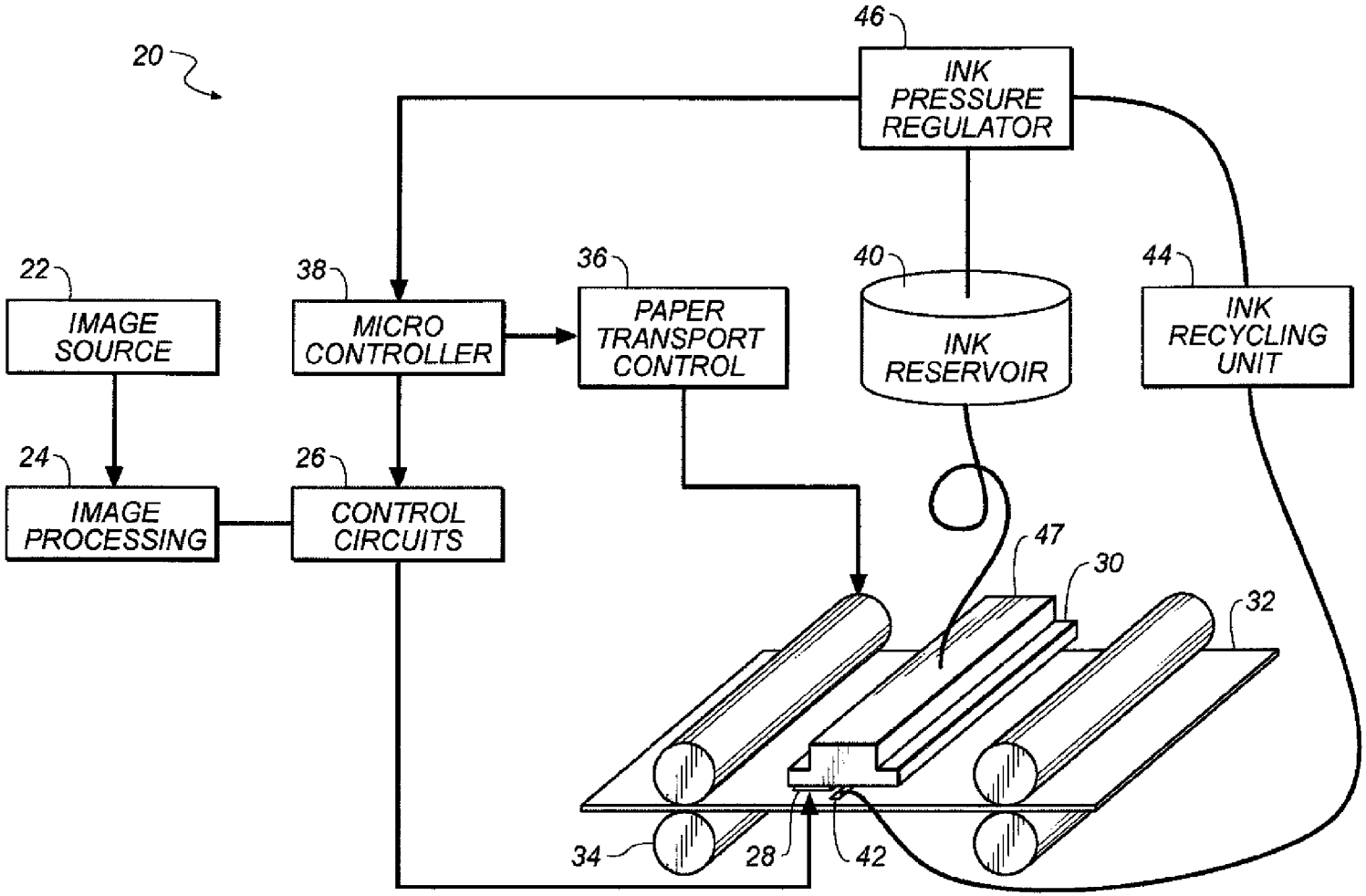
FIG. 1 is a simplified block schematic diagram of an example embodiment of a printing system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead and a printing system typically used to eject inkjet ink. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printing system described below.

Generally described, the present invention provides a DOD (drop on demand) printhead, often referred to as a liquid drop ejector, and printing system that utilizes the Coanda effect with continuous flow of a liquid through the printhead. The Coanda effect refers to the tendency of a stream of liquid to stay attached to a surface rather than follow a straight line in its original direction. The printhead includes at least one device that selectively displaces the liquid to form a drop. This type of printhead is often referred to a flow through device. In one example embodiment of the present invention, the liquid remains attached to a wall of the printhead until perturbation of the liquid flow by an energy source which causes a drop to be formed from the continuous flow of liquid.

When the present invention is compared to conventional DOD printing systems, nozzle refill time and nozzle perturbation are reduced enabling faster subsequent drop formation. Additionally, the present invention provides for increased printing speeds and longer drop throw distance when compared to conventional DOD printing systems.

The flow through liquid drop ejector of the present invention releases liquid drops from a continuous flow of liquid only as required for printing rather than at a fixed frequency. This type of liquid drop ejector produces fewer free drops than conventional CIJ (continuous inkjet) systems and provides advantages over conventional CIJ systems. Some of these advantages include less ink evaporation, better dot placement, lower energy requirements, less data system overhead, and no need to catch non-printing drops. Furthermore, the present invention offers higher reliability from crooked jets, simplifies liquid handling and printhead maintenance, and offers the possibility of tighter packing of different color printheads which helps to enhance color-to-color registration.

Example embodiments including various surface arrangements and liquid excitation devices are shown and described below. These example embodiments are not intended to be a comprehensive description of all surface arrangements and liquid excitation devices suitable for use with the present invention.

Referring to FIG. 1, a DOD ink jet printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a liquid drop ejector 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic diagram only, and many different mechanical configurations are possible. For example, a transfer roller could be used as recording medium transport system 34 to facilitate transfer of the ink drops to recording medium 32. Such transfer roller technology is well known in the art. When liquid drop ejector 30 is a page wide printhead, it is typically more convenient to move recording medium 32 past a stationary printhead. When liquid drop ejector 30 is a scanning printhead, it is usually more convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which can allow at least a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46.

The ink is distributed to liquid drop ejector 30 through an ink channel 47. The ink preferably flows through slots and/or holes etched through a silicon substrate of liquid drop ejector 30 to its front surface, where a plurality of nozzles and drop forming mechanisms, for example, heaters, are situated. When liquid drop ejector 30 is fabricated from silicon, drop forming mechanism control circuits 26 can be integrated with the liquid drop ejector 30.

Figure 2:
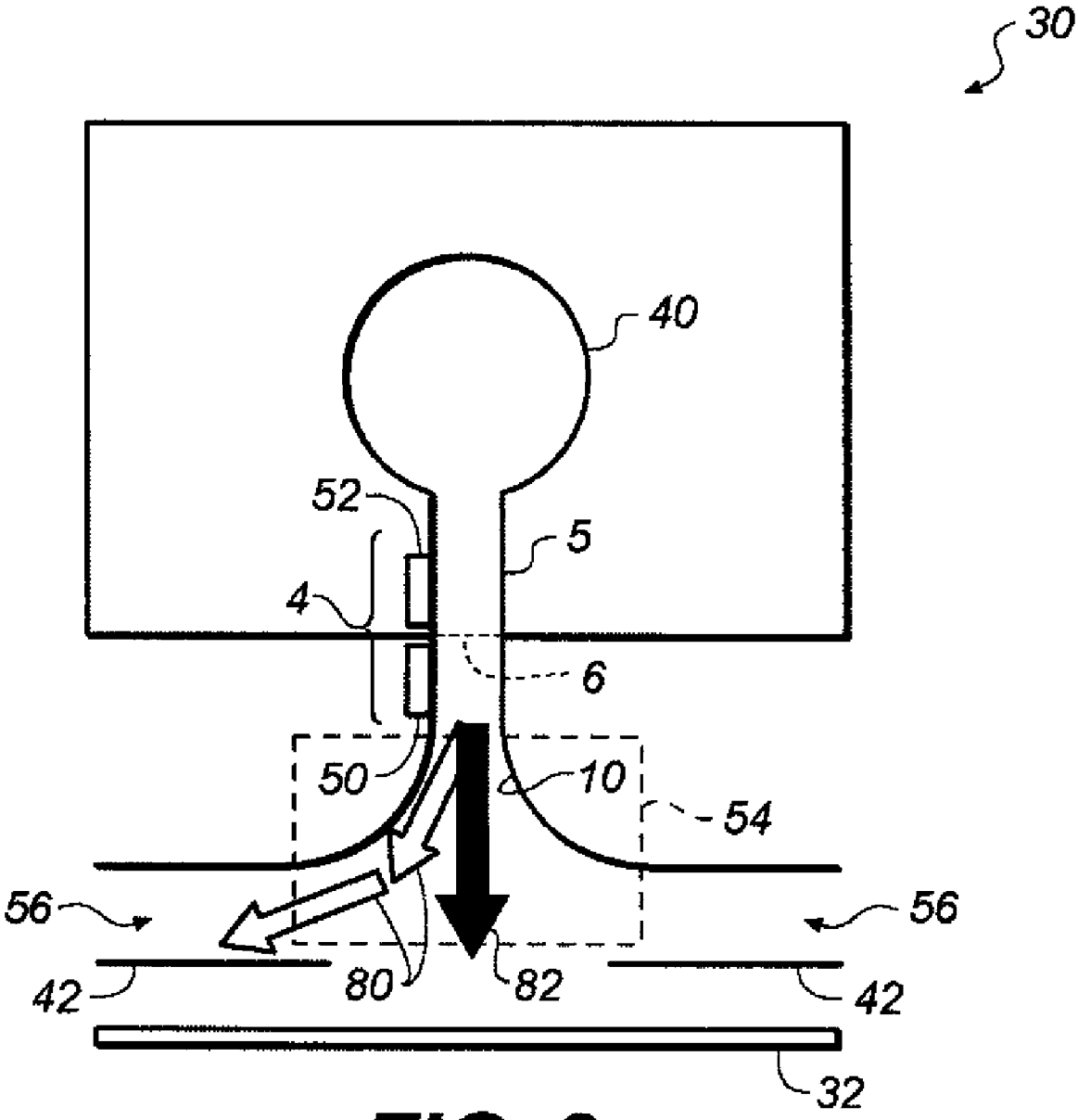
FIG. 2 is a cross-sectional schematic diagram of an example embodiment of a printhead, also referred to as a liquid drop ejector, according to the present invention.

Referring now to FIG. 2, a cross-sectional schematic diagram of a liquid drop ejector 30, also referred to as a printhead, according to the present invention is shown. Liquid drop ejector 30 includes a liquid reservoir 40 which provides a liquid to the nozzle structure 4. Nozzle structure 4 includes a nozzle 5 having an end 6, and a wall 10 which extends from the nozzle end 6.

As shown in FIG. 2, wall 10 includes a radius of curvature, although the wall 10 can also be straight or include angles, as described below. The radius of curvature of wall 10 is such that the normal flow will guide liquid through the nozzle 5 and along the wall 10. Flow will continue along the wall 10 to the liquid return channel 56, defined by the wall 10 and ink gutter 42. This normal flow is shown using arrows 80. Liquid in the liquid return channel 56 can be recycled to the liquid reservoir 40 or can be disposed of, depending on the specific application contemplated.

When printing is desired, a thermal actuator 50 associated with the wall 10 is energized such that a local disturbance created in the liquid will produce a directional change in the flow of at least a portion of the liquid causing it to detach from wall 10, as shown using solid arrow 82. Then, thermal actuator 50 associated with the wall 10 is de-energized while the thermal actuator 52 associated with the nozzle 5 is energized, causing a directional change in the liquid that induces the flow to return to its original flow direction along the wall 10, as shown using arrows 80. This destabilization of the liquid causes a portion of liquid flowing to break off and create a drop. Intermittent switching of the thermal actuators 50 and 52 causes liquid from the continuous flow to be shaved off to create individual drops that are delivered toward and ultimately contact print media 32. Thermal actuators 50 and 52 can be, for example, the heaters known and used in the continuous inkjet printing industry. These heaters are often referred to using various terminologies, for example, asymmetric heaters, segmented heaters, or partial ring heaters.

Figure 4:
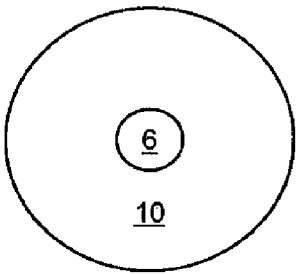
FIG. 4 is a plan view of an example embodiment of a nozzle structure according to the present invention.
Figure 3:
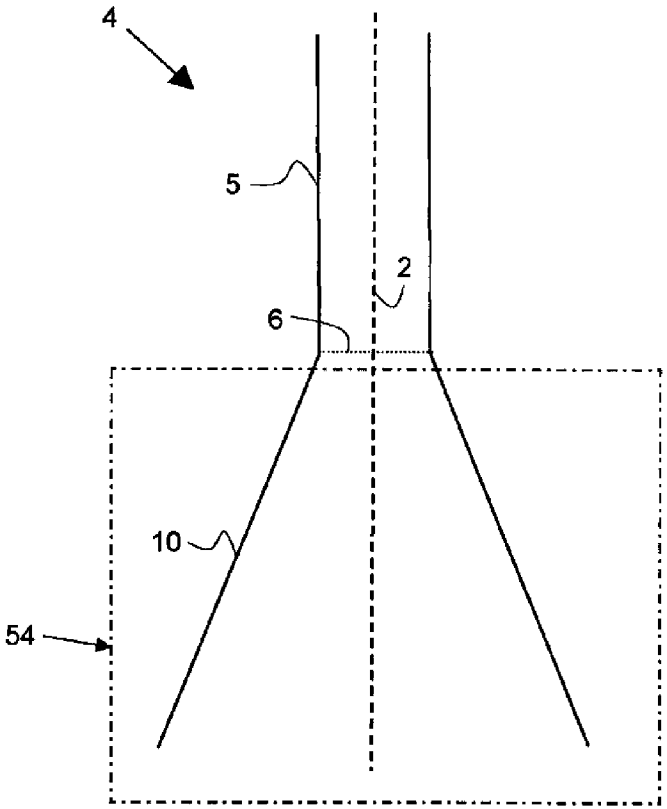
FIG. 3 is a simplified partial cross sectional schematic diagram of an example embodiment of a nozzle structure according to the present invention.

FIGS. 3 and 4 show an example embodiment of a nozzle structure 4 according to the present invention. Nozzle structure 4 has a centerline 2 as viewed from a plane perpendicular to the nozzle structure 4. The centerline 2 divides the nozzle 5 of the nozzle structure 4 in half when viewing the cross section of the nozzle structure 4. A liquid reservoir (shown in FIG. 2) provides ink, or other liquids, under pressure to the top of the nozzle structure 4 so that the liquid flows from top to bottom in this figure. The nozzle structure 4 includes a nozzle 5 and a wall 10. The nozzle 5, typically formed in a nozzle orifice plate, includes an end 6. In FIG. 3, (and FIGS. 2 and 8-18), the end 6 of the nozzle 5 is shown using a horizontal dotted line. The end 6 of the nozzle 5 functions as a liquid flow exit point beyond which there is an expansion zone 54 created by the wall(s) 10. The wall 10 extends from the end 6 of the nozzle 5. When compared to the distance from the nozzle 5 to the centerline 2, the distance from the wall to the centerline 2 is greater than the distance from the nozzle 5 to the centerline 2. This change in distance can be gradual, as shown, for example, in FIGS. 2, 3, 5 and 7-9, or abrupt, as shown, for example, in FIGS. 6, 10 and 14.

Figure 5:
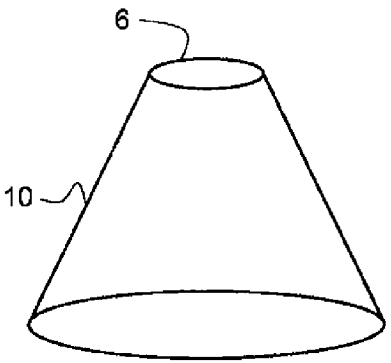
FIG. 5 is a perspective view of an example embodiment of a nozzle structure according to the present invention.
Figure 7:
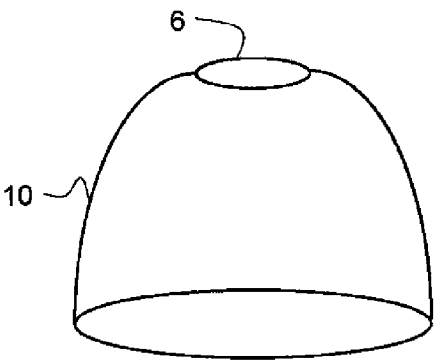
FIG. 7 is a perspective view of another example embodiment of a nozzle structure according to the present invention.
Figure 6:
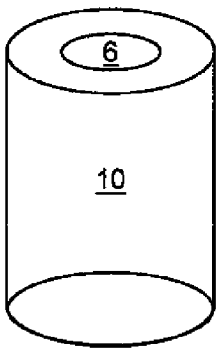
FIG. 6 is a perspective view of another example embodiment of a nozzle structure according to the present invention.

Example embodiments of the present invention can include one wall 10 positioned on one side of nozzle 5, two (or more walls, for example three or four) walls 10 positioned on opposite sides of nozzle 5, or a continuous wall 10 positioned around nozzle 5. For example, wall 10 can extend from nozzle end 6 in the shape of a cone as shown in FIG. 5, or in the shape of a cylinder as shown in FIG. 6. Wall(s) 10 can also include a radius of curvature, as shown in FIGS. 2 and 7. Other wall 10 shapes are also permitted depending on the specific application contemplated.

Referring to FIGS. 5, 7-9, 11 and 12, and back to FIGS. 2 and 3, in some example embodiments of the present invention, a first end 86 (an end closest to nozzle end 6) of the wall 10 is positioned closer in distance to the centerline 2 than a second end 88 (an end closest to catcher 42) of the wall 10. This creates an expansion zone 54, depicted as a dashed line box in FIGS. 2 and 3.

Referring to FIGS. 6, 10, 13 and 14, in other example embodiments of the present invention, wall(s) 10 include a right angle. In these embodiments, wall 10 includes the portion of the wall preceding the right angle and the portion of the wall following the right angle, the vertical and horizontal portions as shown in the figures. In these embodiments, the expansion zone 54 is defined by the horizontal portion of the wall 10 that includes an end 90 that is farther from centerline 2 than nozzle 5.

Figure 10:
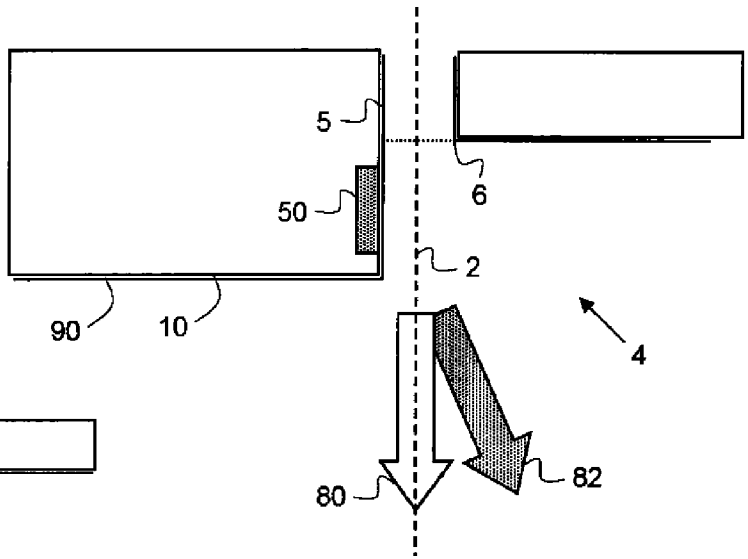
FIG. 10 is another example embodiment of a liquid drop ejector according to the present invention in which the angle of the wall of the nozzle structure is such that the flow normally does not attach to the wall.
Figure 9:
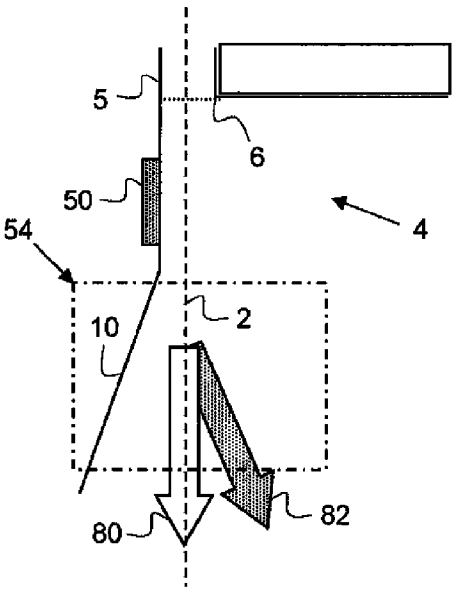
FIG. 9 is another example embodiment of a liquid drop ejector according to the present invention in which the angle of the wall of the nozzle structure is such that the flow normally does not attach to the wall.
Figure 8:
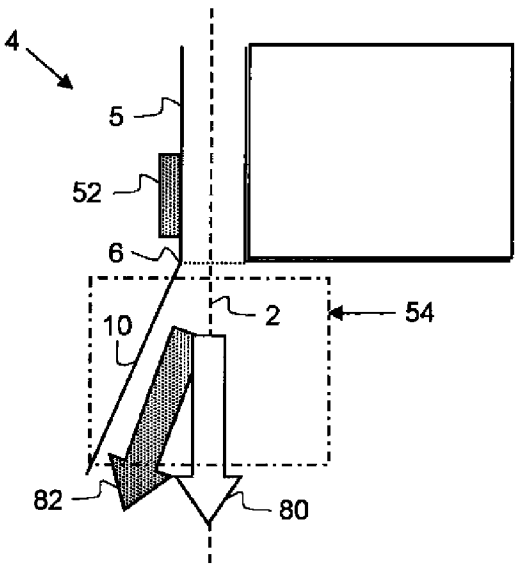
FIG. 8 is another example embodiment of a liquid drop ejector according to the present invention in which the angle of the wall of the nozzle structure is such that the flow normally does not attach to the wall.
Figure 11:
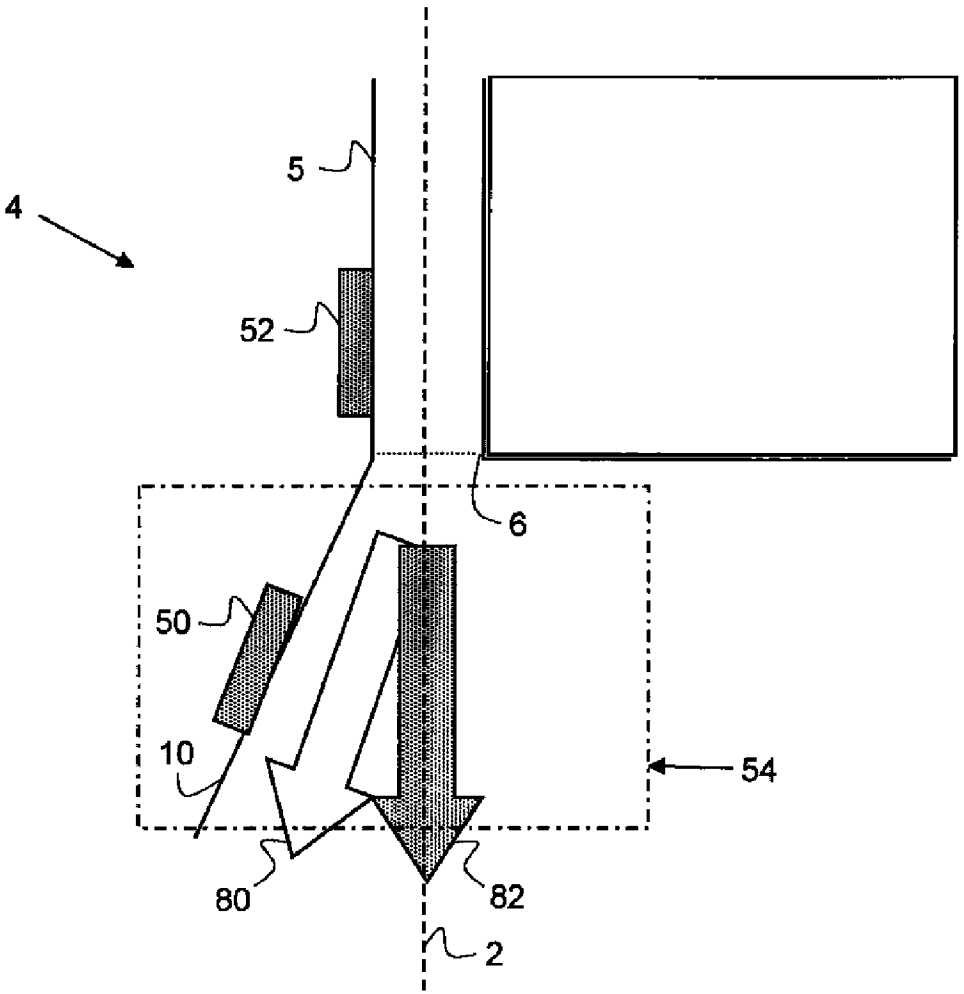
FIG. 11 is an example embodiment of a liquid drop ejector according to the present invention including a single-sided dual thermal actuator arrangement.

In the nozzle structure 4 embodiments described above with reference to FIGS. 2-7, wall 10 is symmetric about centerline 2. FIGS. 8-10 describe example embodiments in which wall 10 is not symmetric about the centerline 2. In these example embodiments, the distance from wall 10 to centerline 2 changes abruptly at nozzle end 6 on one side of the centerline (the right side as shown in the figures) and doesn't change or changes gradually on the other side of the centerline (the left side as shown in the figures) at a location of wall 10 after nozzle end 6. With the change in wall 10 spacing to centerline 2 occurring later or more gradually on the left side of nozzle structure 4 when compared to the right side of nozzle structure 4, liquid flow tends to separate from the right side wall before separating from the left side wall. As such, the left side wall tends to control the directionality of the liquid as it leaves nozzle 5.

Referring now to FIGS. 8-10, example embodiments of the present invention are shown in which wall 10 is angled relative to centerline 2 with the angle being of sufficient magnitude that the flow normally will not attach to the wall 10 without the addition of thermal energy at the nozzle 5. As shown in FIG. 8, the entire wall 10 can be angled beginning at the end 6 of the nozzle 5 to create expansion zone 54. Alternatively, as shown in FIGS. 9 and 10, wall 10 can include a portion parallel to the centerline 2 and a portion angled relative to the centerline 2 that defines the expansion zone 54.

Typically, wall 10 is at an angle of greater than about 15 degrees from the centerline 2, though the particular angle can be any angle that causes the liquid to tend to continue flowing in substantially a straight line in its original direction rather than staying attached to wall 10. In these example embodiments, the liquid is said to continue flowing in a substantially straight line in its original direction because, even though the liquid flow does not stay attached to wall 10, the liquid flow exiting nozzle 5 can bend for a period of time and isn't necessarily immediately perpendicular to nozzle end 6 and travelling along centerline 2.

In FIGS. 8-10, solid arrows 82 indicate liquid motion when a thermal actuator is energized while arrows 80 indicate liquid motion when the thermal actuator is not energized. In FIG. 8, a thermal actuator 52 is located within the nozzle 5 and is operatively associated with nozzle 5 to cause a directional change in a liquid flowing through the nozzle structure 4 by adding surface energy to the nozzle 5. That is, when the thermal actuator 52 associated with the nozzle 5 is energized, the localized surface effects cause the liquid motion to be redirected and the liquid to attach to the wall 10, as shown using solid arrow 82. These surface effects include a complex combination of lower viscosity, surface tension, and increased localized velocity. De-energizing the thermal actuator 52 reverses these effects and the liquid is detached from wall 10, as is shown using arrow 80.

In FIG. 9 the thermal actuator 50 external to the nozzle 5 and associated with the wall 10 prior to the formation of the expansion zone 54. Thermal actuator 50 is operatively associated with the wall 10 to cause a directional change in a liquid flowing through the nozzle structure 4 by adding surface energy to the wall 10.

The resultant flow for the thermal actuator 52 associated with the nozzle 5 versus the thermal actuator 50 associated with the wall 10 is significant. In the embodiment shown in FIG. 8, when the thermal actuator 50 is de-energized, the liquid flows in a substantially straight line, as shown using arrow 80. However, when the thermal actuator 50 associated with the wall 10 is energized, the localized surface effects cause the liquid motion to be redirected and the liquid is deflected further away from the wall 10 and centerline 2, shown using solid arrow 82. These surface effects include a complex combination of lower viscosity, surface tension, and increased localized velocity. De-energizing the thermal actuator 50 reverses these effects and the liquid returns to its initial path. It should be appreciated that in the embodiment shown in FIG. 9, the thermal actuator 50 is located upstream from the point of divergence in the liquid path, or prior to the formation of the expansion zone 54. Additionally, the actual structures of the walls and nozzles can vary from the illustration and depend on the fabrication technique, allocated space, and other physical restraints of the printhead.

Referring to FIG. 10, a thermal actuator 50 is located external to nozzle 5, and is associated with the wall 10, as described with reference to FIG. 9. However, in contrast to FIG. 9, the wall 10 includes a right angle, and a portion of the wall 10 is orthogonal to the centerline of the nozzle structure 4, forming the expansion zone 54. The actuator 50 is operatively associated with the wall 10 to cause a directional change in a liquid flowing through the nozzle structure 4 by adding surface energy to the wall 10 upstream of the expansion zone 54. When the thermal actuator 50 is de-energized, the liquid flows in a substantially straight line, as shown using arrow 80. However, when the thermal actuator 50 associated with the wall 10 is energized, the localized surface effects cause the liquid motion to be redirected and the liquid is deflected further away from the wall 10 and centerline 2, shown using solid arrow 82. These surface effects include a complex combination of lower viscosity, surface tension, and increased localized velocity. De-energizing the thermal actuator 50 reverses these effects and the liquid returns to its initial path. Again, it should be appreciated that in this embodiment, the thermal actuator 50 is located upstream from the point of divergence in the liquid path. Thus, an actuator associated with the nozzle will "pull" the liquid towards the wall 10 while an actuator associated with the wall 10 upstream from the point of divergence will "push" the liquid further from the wall 10.

Placement of the thermal actuator is not limited to upstream from the point of divergence of the liquid path. In the example embodiment shown in FIG. 11, a thermal actuator 50 is operatively associated with the wall 10 downstream of the point of divergence of the liquid path, or in the expansion zone 54, is used in combination with the first thermal actuator 52 associated with the nozzle 5. In this embodiment, the angle of the wall 10 relative to the centerline 2 is of sufficient magnitude to induce wall attachment without the addition of energy. Even though attachment occurs, the liquid flow is near instability. Typically, the angle of the wall 10 relative to the centerline 2 is less than about 15 degrees. However, the particular angle of the wall 10 can vary provided the liquid within the channel moves through the nozzle structure 4 along the wall 10 due to the Coanda effect, yet is near instability such that it can be removed from the wall with the addition of energy. If the wall is at too small of an angle, the flow will remain attached to one side, or even both sides, and will not switch upon activation of the actuator(s). When the appropriate angle is used, normal flow will guide liquid through the nozzle structure 4 and along the wall 10.

When the thermal actuator 50, associated with the wall 10, is energized, a local disturbance is created in the liquid and causes the liquid to detach from wall 10, as shown using solid arrow 82. Then, by energizing the thermal actuator 52 associated with the nozzle 5 while de-energizing the actuator 50 associated with the wall 10, the liquid is returned to initial flow pattern along the wall 10, as shown using arrow 80. This single-side dual thermal actuator arrangement allows for greater control of the liquid direction and faster switching print speeds than embodiments utilizing only one thermal actuator, though it is possible to use only the actuator 50 associated with the wall 10 to achieve detachment.

Figure 13:
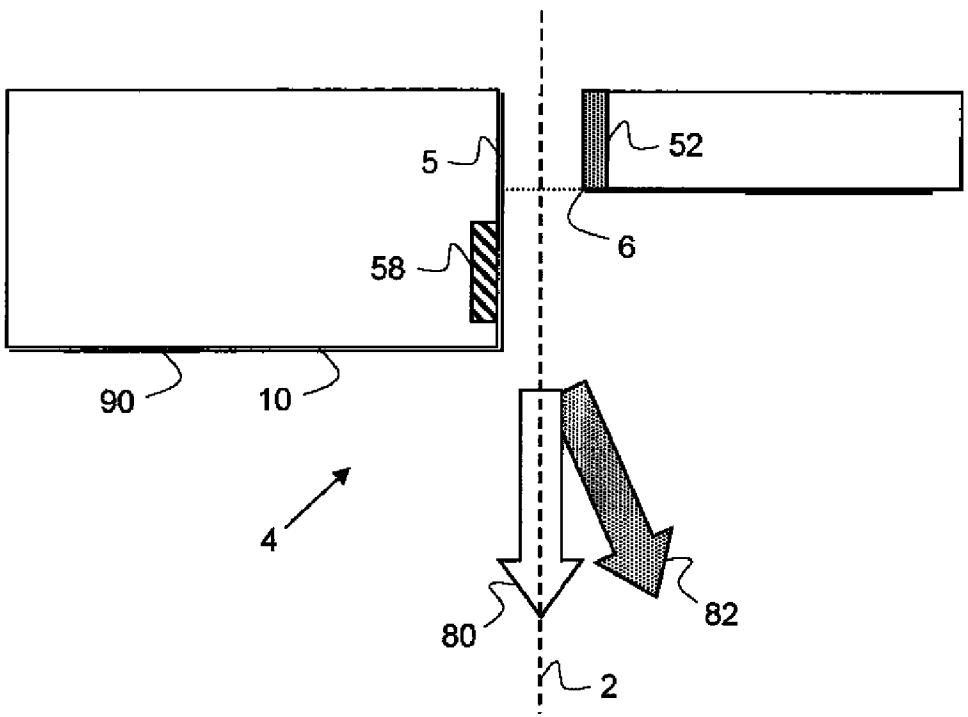
FIG. 13 is another example embodiment of a liquid drop ejector according to the present invention including thermal and piezoelectric actuators.
Figure 12:
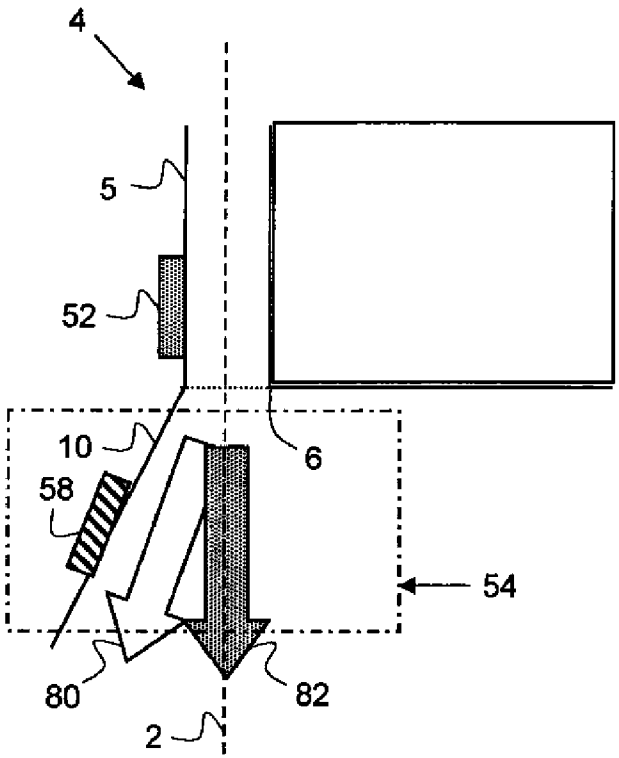
FIG. 12 is an example embodiment of a liquid drop ejector according to the present invention including thermal and piezoelectric actuators.

Referring now to FIGS. 12 and 13, embodiments using both thermal and PZT (piezoelectric) actuators are shown. PZT actuators are shown as cross hatched blocks, while thermal actuators are depicted throughout as solid blocks (as was the case in the figures previously discussed).

FIG. 12 illustrates an embodiment wherein the angle of the wall 10 relative to the centerline 2 is of sufficient magnitude to promote wall attachment without the addition of energy. Typically, the angle of the wall 10 relative to the centerline 2 is less than about 15 degrees. However, the particular angle of the wall 10 can vary provided the liquid within the channel moves through the nozzle structure 4 along the wall 10 due to the Coanda effect, yet is near instability such that it can be removed from the wall with the addition of energy. If the wall is at too small of an angle, the flow will remain attached to one side, or even both sides, and will not switch upon activation of the actuators. When the appropriate angle is used, normal flow will guide liquid through the nozzle structure 4 and along the wall 10.

In FIG. 12, a thermal actuator 52 is associated with the nozzle 5, and a PZT actuator 58 is associated with the wall 10 in the expansion zone 54. When both actuators 52 and 58 are de-energized, the liquid flow is through the nozzle structure 4 and along the wall 10, as shown using arrow 80. When the PZT actuator 58 is energized, it creates a liquid perturbation sufficient to eject the liquid flow from the wall 10, as shown using solid arrow 82. Then, by energizing the thermal actuator 52 associated with the nozzle 5 while de-energizing the PZT actuator 58 associated with the wall 10 in the expansion zone 54, the liquid is returned to initial flow pattern along the wall 10 in the expansion zone 54, shown using arrow 80. As with the arrangement shown in FIG. 11, the arrangement shown in FIG. 12 allows for greater control of the liquid direction and faster print speeds than embodiments utilizing only one thermal actuator.

In the embodiment shown in FIG. 13, thermal actuator 52 and PZT actuator 58 are located on opposing sides of the nozzle structure 4. The thermal actuator 52 is operatively associated with the nozzle 5 to cause a directional change in a liquid flowing through the nozzle structure 4 by adding surface energy to the nozzle 5 while the PZT actuator 58 is operatively associated with the wall 10 before the expansion zone 54 and opposite the thermal actuator 52. Placement of the thermal actuator 52 opposite the PZT actuator 58 creates a steering effect similar to thermal steering in CIJ (continuous inkjet) systems. When both actuators 52 and 58 are de-energized, the liquid path direction will be substantially along the centerline 2, shown using arrow 80, because wall 10 includes a right angle that the liquid flow typically does not follow. Upon activation of the thermal actuator 52 and/or the PZT actuator 58, the liquid will bend toward the direction of the thermal actuator 52, as shown using solid arrow 82. Thermal actuator 52 associated with the nozzle 5 pulls the liquid flow towards it while the PZT actuator 58 pushes the liquid flow away from the wall 10 with which it is associated.

Figure 14:
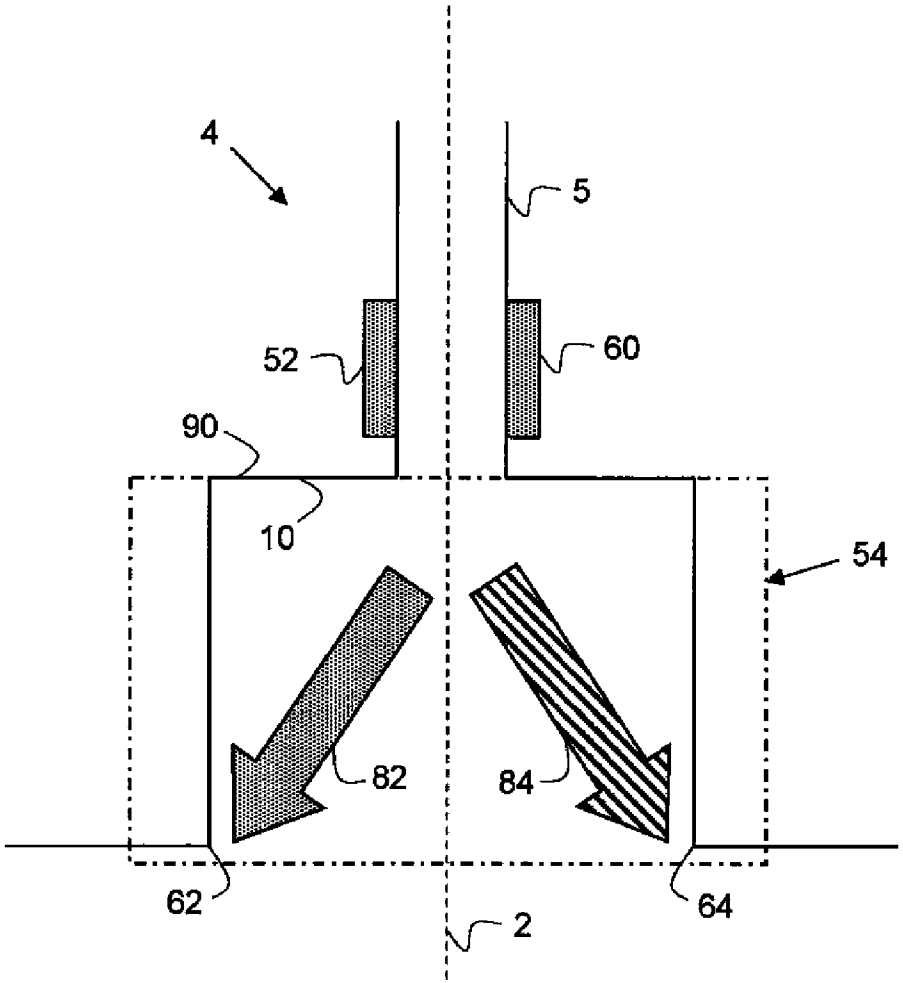
FIG. 14 is an example embodiment of a liquid drop ejector according to the present invention including a dual-sided thermal actuator arrangement.

FIG. 14 illustrates a dual thermal actuator arrangement with heaters on opposite sides of the nozzle. In this embodiment, thermal actuators 52 and 60 are operatively associated with the nozzle 5 and oppose each other. A perspective view of this example embodiment is shown in FIG. 6. The wall 10 includes a first portion which is orthogonal relative to centerline 2. The orthogonal angle has a magnitude that normally prevents the flow from attaching to the wall 10. Wall 10 also includes a second portion which is parallel to the centerline 2, though farther from the centerline 2 than the nozzle 5, thereby defining the expansion zone 54. Wall 10 has flow attachment points 62 and 64 where the liquid reattaches to a side. When both thermal actuators 52 and 60 are de-energized, the liquid flow path will be substantially along the center line, because the orthogonal angle of the wall 10 prevents the flow from attaching to the wall 10 without the addition of thermal energy. When thermal actuator 52 is energized, the liquid flow path bends in the direction of thermal actuator 52 and attaches to the wall 10 at liquid attachment point 62, as shown using solid arrow 82. When thermal actuator 60 is energized, the liquid flow path bends in the direction of thermal actuator 60 and attaches to the wall 10 at liquid attachment point 64, as shown using cross hatched arrow 84. This arrangement is advantageous because it provides for simplified fabrication in that no acutely angled walls need to be formed. It should be noted that the liquid attachment points 62 and 64 can be a part of the nozzle structure itself or can be a separate part that is accurately positioned exterior to the nozzle structure geometry.

Figure 16:
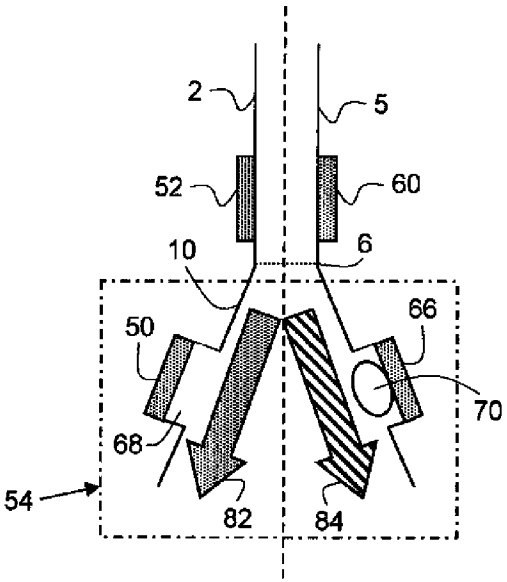
FIG. 16 is an example embodiment of a liquid drop ejector according to the present invention including offset cavities.
Figure 17:
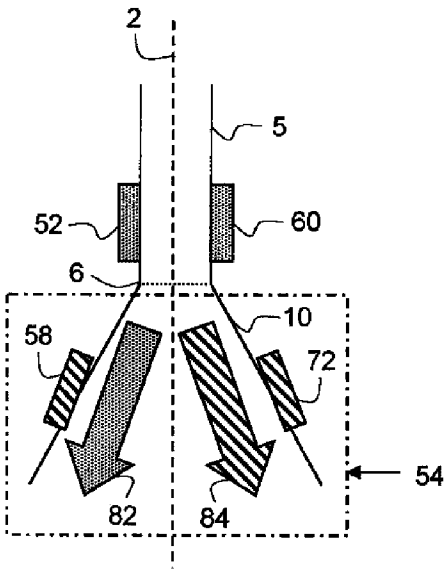
FIG. 17 is an example embodiment of a liquid drop ejector according to the present invention including two thermal actuators and two piezoelectric actuators.
Figure 15:
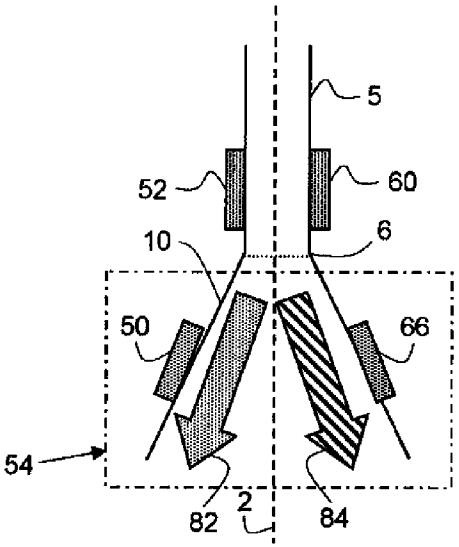
FIG. 15 is an example embodiment of a liquid drop ejector according to the present invention including four thermal actuators.

FIGS. 15-17 show additional example embodiments in which four actuators are used in combination to provide enhanced liquid directional control and improved frequency response when compared to nozzle structures that do not include four actuators. A perspective view of the example embodiments shown in FIGS. 15 and 17 is shown in FIG. 5.

In FIG. 15, four thermal actuators are used in combination, two actuators 52 and 60 being operatively associated with the nozzle 5 and two actuators 50 and 66 being operatively associated with the wall 10 and in the expansion zone 54. The two actuators 52 and 60 associated with the nozzle 5 are located opposite one another, as are actuators 50 and 66 associated with the wall 10 in the expansion zone 54. By coordinating the activation of actuators 52 and 66 or 50 and 60, the liquid flow alternates between the opposing walls with a "push-pull" action. For example, when actuator 52 and actuator 66 are energized, energy supplied by actuator 66 helps to detach or push the flow from the wall on the right side while the energy supplied to the actuator 52 serves to attract or pull the flow to the wall on the left side of the figure, illustrated using solid arrow 82. When actuator 50 and actuator 60 are energized the flow is pushed off from the left wall and pulled over to the right side wall of the figure, illustrated using cross hatched arrow 84. As the flow is switched from being attached to one wall to attachment to the opposite wall, a drop of liquid is ejected for printing. Another advantage of this system is precise jet directionality as determined by the two wall attachment points. The additional energy sources included in this embodiment help to provide greater control and faster switching. Additionally, the energy sources help to "pin" the flow to the wall to prevent intermittent and localized flow separation from the wall surface.

In FIG. 16, thermal actuators 52 and 60 are operatively associated with the nozzle 5, and the thermal actuators 50 and 66 operatively associated with wall 10 and in the expansion zone 54. As above, actuators 52 and 60 oppose one another. Similarly, actuators 50 and 66 oppose one another. Thermal actuators 50 and 66 are placed within an offset cavity 68 in the wall 10 in the expansion zone 54. As above, when thermal actuators 50 and 66 are energized, the liquid flows along the path illustrated using solid arrow 82. When thermal actuators 50 and 60 are energized, the liquid will follow the path illustrated using cross hatched arrow 84. The offset cavity 68 provides for the ability to implement another form of thermal activation where the localized temperature is sufficient to cause liquid evaporation (such as in bubble jet type DOD printing systems). This embodiment has the advantage of maintaining a stagnation zone over the heater such that it is easier to heat the liquid to the vaporization point. The vapor bubble 70 acts as a piston to drive the attached liquid stream off of the wall 10 toward the opposite side, increasing the effect of the thermal actuator associated with it.

In FIG. 17, the actuators associated with the wall 10 in the expansion zone 54 are PZT actuators (58 and 72). Two thermal actuators 52 and 60 are operatively associated with the nozzle 5 and oppose one another. In this embodiment, the liquid is pulled toward the wall 10 of an activated thermal actuator (52 and 60) or pushed away from the wall 10 of the PZT actuators (58 and 72). Thus, when thermal actuator 52 and PZT actuator 72 are energized, the liquid will follow a path illustrated using solid arrow 82. When thermal actuator 60 and PZT actuator 58 are energized, the liquid will follow a path illustrated using cross hatched arrow 84. The additional energy sources included in this embodiment help to provide greater control and faster switching.

Figure 19:
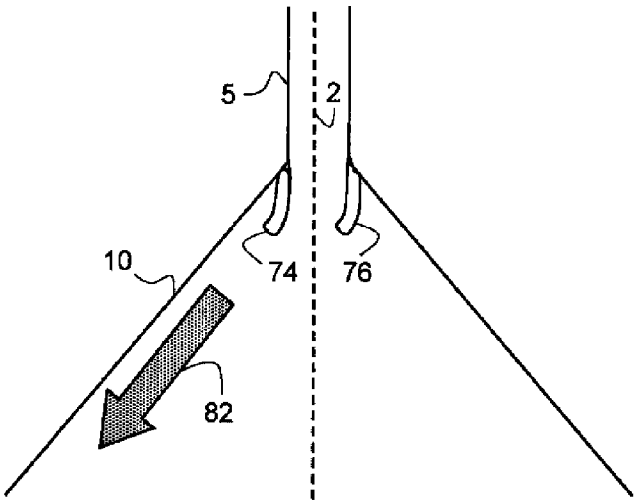
FIG. 19 is an example embodiment of a liquid drop ejector according to the present invention including longitudinally deflecting actuators shown in a deformed state.
Figure 20:
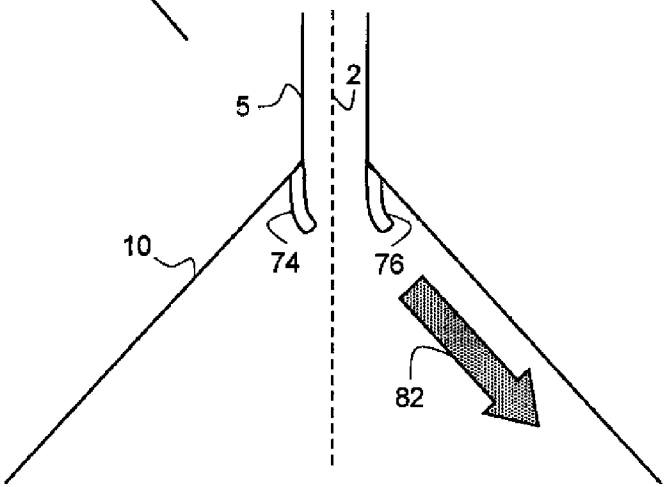
FIG. 20 is another example embodiment of a liquid drop ejector according to the present invention including longitudinally deflecting actuators shown in a deformed state.
Figure 18:
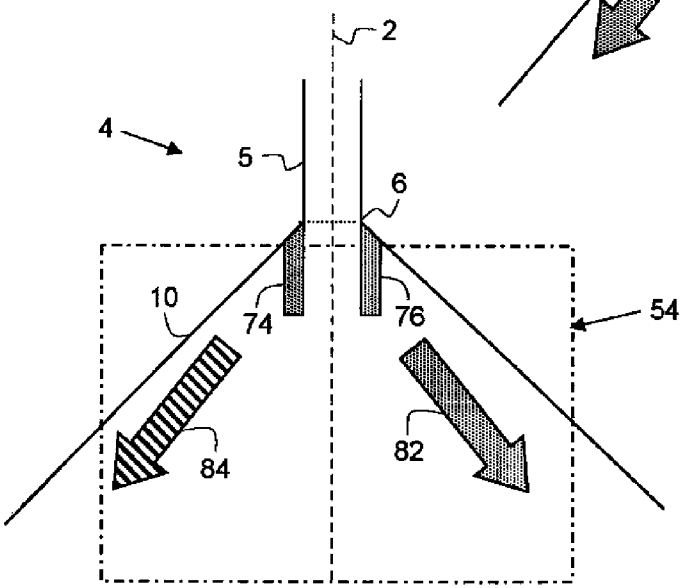
FIG. 18 is an example embodiment of a liquid drop ejector according to the present invention including longitudinally deflecting actuators shown in an un-deformed state.

FIGS. 18-20 show example embodiments of the present invention that include an alternative actuator arrangement. FIG. 18 shows the actuators in an un-deformed, de-energized state while FIGS. 19 and 20 depict the actuators as longitudinally deflected. In these embodiments, actuators 74 and 76 are located at the junction between the nozzle 5 and the wall 10 defining the expansion zone 54, and are exposed within nozzle structure 4. In FIG. 18, the exposed actuators 74 and 76 are thermal and constructed of a bi-metallic strip in which one side of the strip is heated to cause thermal asymmetrical thermal expansion resulting in longitudinal deflection of the strip. The jet steering is in the direction of deflection of the end of the thermal strip and pined at the adjacent wall 10 via coanda attachment. Thus, when the actuators 74 and 76 are actuated such that they bend to the left, the liquid will follow a path illustrated using cross hatched arrow 84, or along the path as shown in FIG. 19. When the actuators 74 and 76 are actuated such that they bend to the right, the liquid will follow a path illustrated using solid arrow 82, or along the path as shown in FIG. 20. In an alternative configuration, actuators 74 and 76 can be bimorph piezoelectric actuators or be formed from a shearing mode piezoelectric material. Other materials can be used, provided that, when actuated, the actuators deform similarly to the bi-metallic strips described above.

The invention has been described in detail with particular reference to certain preferred embodiments thereof, but it will be understood that variations and modifications can be effected within the scope of the invention.

PARTS LIST

2. Centerline
4. Nozzle structure
5. Nozzle
6. Nozzle end
10. Wall
20. Ink jet printing system
22. Image source
24. Image processing unit
26. Control circuits
28. Drop deflection means
30. Print head
32. Print media
34. Recording media transport system
36. Paper transport control
38. Micro controller
40. Ink reservoir
42. Ink gutter
44. Ink recycling unit
46. Ink pressure regulator
47. Ink channel device
50. Thermal actuator associated with wall
52. Thermal actuator associated with nozzle
54. Expansion zone
56. Liquid return channel
58. PZT actuator
60. Second thermal actuator associated with nozzle
62. Flow attachment point
64. Flow attachment point
66. Second thermal actuator associated with wall
68. Offset cavity
70. Bubble
72. PZT actuator
74. Exposed actuator
76. Exposed actuator
80. Arrow
82. Solid arrow
84. Cross hatched arrow
86. First end of wall
88. Second end of wall
90. End of wall

The invention claimed is:

1. A liquid drop ejector comprising:

a nozzle structure including a nozzle and a wall, the nozzle including an end, the wall extending from the end of the nozzle, the nozzle structure having a centerline as viewed from a plane perpendicular to the nozzle structure, the wall including a first end and a second end, the second end being farther away from the centerline of the nozzle when compared to the first end so as to create an expansion zone; and a thermal actuator associated with at least one of the nozzle and the wall, the thermal actuator being operable to add surface energy to at least one of the nozzle and the wall to cause a directional change in a liquid flowing through the nozzle structure.

2. The liquid drop ejector of claim 1, wherein the thermal actuator is associated with the nozzle, the thermal actuator being operable to direct the liquid flowing through the nozzle structure toward the wall.

3. The liquid drop ejector of claim 1, wherein the thermal actuator is associated with the wall, the thermal actuator being operable to direct the liquid flowing through the nozzle structure away from the wall.

4. The liquid drop ejector of claim 1, wherein the thermal actuator is a first thermal actuator, the liquid drop ejector further comprising:

a second thermal actuator operatively associated with at least one of the nozzle and the wall to cause a directional change in a liquid flowing through the nozzle structure.

5. The liquid drop ejector of claim 4, wherein the first thermal actuator is operatively associated with the nozzle and the second thermal actuator is operatively associated with the wall.

6. The liquid drop ejector of claim 4, wherein the first thermal actuator and the second thermal actuator are operatively associated with the nozzle.

7. The liquid drop ejector of claim 4, the liquid drop ejector further comprising:

a third thermal actuator operatively associated with at least one of the nozzle and the wall; and a fourth thermal actuator operatively associated with at least one of the nozzle and the wall, the third and fourth heaters being operable to add surface energy to at least one of the nozzle and the wall in order to cause a directional change in a liquid flowing through the nozzle structure.

8. The liquid drop ejector of claim 4, the wall including a cavity, at least one of the first and second thermal actuators being located within the cavity.

9. The liquid drop ejector of claim 1, the nozzle structure having a centerline as viewed from a plane perpendicular to the nozzle structure, the wall including a portion that is parallel to the centerline of the nozzle structure.

10. The liquid drop ejector of claim 1, the nozzle structure having a centerline as viewed from a plane perpendicular to the nozzle structure, the wall including a portion that is orthogonal to the centerline of the nozzle structure.

11. The liquid drop ejector of claim 1, wherein the thermal actuator is a heater.

12. The liquid drop ejector of claim 4, the first and second thermal actuators being associated with an end of the nozzle, the first and second thermal actuators including a bimetallic strip, the bimetallic strips being longitudinally deflectable, the deflection of the bimetallic strips being sufficient to cause a directional change in a liquid flowing through the nozzle.

13. A method of ejecting liquid through a liquid drop ejector comprising:

providing a nozzle structure including a nozzle and a wall, the nozzle including an end, the wall extending from the end of the nozzle, the nozzle structure having a centerline as viewed from a plane perpendicular to the nozzle structure, the wall including a first end and a second end, the second end being farther away from the centerline of the nozzle when compared to the first end so as to create an expansion zone; and causing a directional change in a liquid flowing through the nozzle structure by actuating a thermal actuator that is operatively associated with one of the nozzle and the wall to add surface energy to one of the nozzle and the wall.

14. The method of claim 13, the thermal actuator being associated with the nozzle, wherein causing the directional change in the liquid flowing through the nozzle structure includes causing the liquid to be directed toward the wall by actuating the thermal actuator associated with the nozzle.

15. The method of claim 13, wherein the thermal actuator is associated with the wall, the thermal actuator causing the liquid to be directed away from the wall.

16. A method of ejecting liquid through a liquid drop ejector comprising:

providing a nozzle structure including a nozzle and a wall, the nozzle including an end, the wall extending from the end of the nozzle;

causing a first directional change in a liquid flowing through the nozzle structure by actuating a first thermal actuator that is operatively associated with one of the nozzle and the wall to add surface energy to one of the nozzle and the wall; and causing a second directional change in a liquid flowing through the nozzle structure using a second thermal actuator operatively associated with one of the nozzle and the wall, the second thermal actuator being operable to add surface energy to one of the nozzle and the wall.

17. The method of claim 16, wherein causing the first directional change includes deflecting the liquid flow from a first liquid flow path to a second liquid flow path, and wherein the second directional change in the liquid returns the flow to the first direction of liquid flow.

18. The method of claim 16, wherein the first thermal actuator is operatively associated with the nozzle and the second thermal actuator is operatively associated with the wall.

19. The method of claim 16, wherein the first thermal actuator and the second thermal actuator are operatively associated with the nozzle.

20. The method of claim 16, the first and second thermal actuators being associated with an end of the nozzle, the first and second thermal actuators including a bimetallic strip, wherein causing a directional change in the liquid flowing through the nozzle includes longitudinally deflecting the bimetallic strips.

* * * * *